US007352873B2

(12) United States Patent
Shigeno et al.

(10) Patent No.: US 7,352,873 B2
(45) Date of Patent: Apr. 1, 2008

(54) ELECTRET-CONDENSER MICROPHONE

(75) Inventors: Yasuhiro Shigeno, Hyogo (JP); Mamoru Yasuda, Hyogo (JP); Yasuo Sugimori, Nabari (JP); Naoki Toyoda, Osaka (JP)

(73) Assignee: Hosiden Corporation, Osaka (JP)

( * ) Notice: Subject to any disclaimer, the term of this patent is extended or adjusted under 35 U.S.C. 154(b) by 183 days.

(21) Appl. No.: 10/554,611

(22) PCT Filed: Apr. 25, 2005

(86) PCT No.: PCT/JP2005/007840

§ 371 (c)(1),
(2), (4) Date: Oct. 26, 2005

(87) PCT Pub. No.: WO2005/104616

PCT Pub. Date: Nov. 3, 2005

(65) Prior Publication Data

US 2006/0205244 A1 Sep. 14, 2006

(30) Foreign Application Priority Data

Apr. 20, 2004 (JP) ..... 2004-131206
Aug. 24, 2004 (JP) ..... 2004-243427
Feb. 23, 2005 (JP) ..... 2005-046621

(51) Int. Cl.
*H04R 3/00* (2006.01)
*H04R 25/00* (2006.01)
*H04R 11/04* (2006.01)

(52) U.S. Cl. ..... 381/113; 381/161; 381/174; 381/355; 381/191

(58) Field of Classification Search ..... 381/191, 381/111, 150, 176, 355
See application file for complete search history.

(56) References Cited

U.S. PATENT DOCUMENTS 5,097,515 A * 3/1992 Baba ..... 381/191
6,978,029 B1 * 12/2005 Ikeda ..... 381/111
2006/0177085 A1 * 8/2006 Izuchi et al. ..... 381/369
2007/0010141 A1 * 1/2007 Izuchi et al. ..... 439/876

FOREIGN PATENT DOCUMENTS

JP 2000-197192 7/2000

(Continued)

*Primary Examiner*—Wayne Young
*Assistant Examiner*—Dionne H Pendleton
(74) *Attorney, Agent, or Firm*—David N. Lathrop, Esq.; Gallagher & Lathrop

(57) ABSTRACT

An electret-condenser microphone according to the present invention includes a vibrating diaphragm and a back electrode which compose a condenser; a cylindrical case which houses the vibrating diaphragm and the back electrode; a circuit board which is housed in an opening of the cylindrical case, is fixed to the opening by crimping a crimp edge formed by bending an opening end of the cylindrical case inward, and covers the opening; and a substrate fastened to an outer surface of the circuit board. A circular pattern and annular pattern are formed on the outer surface of the circuit board and a circular pattern and annular pattern are formed on that surface of the substrate which is farther from the circuit board. The circular pattern and annular pattern are connected with the circular pattern and annular pattern via thru-holes in the substrate, and that surface of the substrate on which and are formed serves as a reflow-soldering surface.

1 Claim, 11 Drawing Sheets

FOREIGN PATENT DOCUMENTS

| | | |
|---|---|---|
| JP | 2001-083004 | 3/2001 |
| JP | 2001-095097 | 4/2001 |
| JP | 2001-268695 | 9/2001 |
| JP | 2003-153392 | 5/2003 |
| JP | 2003-259493 | 9/2003 |
| JP | 2004-135223 | 4/2004 |
| JP | 10-2005-0043169 | 5/2005 |
| JP | 2005-135744 | 5/2005 |

* cited by examiner

Prior Art

ELECTRET-CONDENSER MICROPHONE

TECHNICAL FIELD

The present invention relates to an electret-condenser microphone. More particularly, it relates to an electret-condenser microphone which allows proper reflow soldering when it is mounted on a mounting board.

BACKGROUND ART

FIG. 1 is a sectional view showing a conventional configuration example of an electret-condenser microphone (hereinafter referred to as an ECM) 10 which lends itself to reflow soldering and is described in patent literature 1. As shown in the figure, the ECM 10 in this example consists of a vibrating diaphragm 12 and back electrode 13 contained in a conductive cylindrical case 11 and composing a condenser, and a circuit board 14 housed in an opening of the cylindrical case 11 and covering the opening.

The vibrating diaphragm 12 in this example consists of a metal film vapor-deposited on a surface of an electret film. The metal film is fixed to a conductive ring 15 and a surface of the electret is fixed to an insulating spacer 16. The back electrode 13 in this example has conductivity and is fitted in and fixed to a shoulder inside a holder 17. Also, a conductive ring 18 is fitted in the holder 17, being placed in contact with the circuit board 14 and back electrode 13.

The circuit board 14 is fixed to the ECM 10 body by folding and crimping the opening of the cylindrical case 11 inward. That is, the circuit board 14 in this example is fixed to the ring 18 by being pressed against it by the folded crimp edge (peripheral edge) 11*a*. Circuit elements 19 such as an FET (field effect transistor) are mounted on the inner surface of the circuit board 14 and a plurality of solder bump electrodes 21*a* and 21*b* are formed on the outer surface as electrodes for external connection. The back electrode 13 is electrically connected to electrode patterns on the circuit board 14 via the ring 18. On the other hand, the metal film of the vibrating diaphragm 12 is electrically connected to the electrode patterns on the circuit board 14 via the ring 15, cylindrical case 11, and crimp edge 11*a*.

A circular pattern and an annular pattern which encloses the circular pattern are formed as the electrode patterns on the outer surface of the circuit board 14. The solder bump electrodes 21*a* are formed on the circular pattern to serve as signal electrodes (output terminals). Also, the solder bump electrodes 21*b* are formed on the annular pattern to serve as ground electrodes (earth terminals). Furthermore, the crimp edge 11*a* of the cylindrical case 11 is connected to the annular pattern by being held in pressing contact with it. Incidentally, the electrode patterns formed on the inner and outer surfaces of the circuit board 14 are omitted from FIG. 1.

The ECM 10 in this example is mounted on a mounting board by placing solder bump electrodes 21*a* and 21*b* of the ECM 10 on a solder layer formed on a wiring pattern on the mounting board, heating them with a reflow apparatus, and thereby melting them (reflow soldering).

Patent literature 1: Japanese Patent Application Laid-Open No. 2003-153392

DISCLOSURE OF THE INVENTION

Issues to be Solved by the Invention

As described above, the crimp edge 11*a* of the cylindrical case 11 is placed on the outside edge of the circuit board 14 of the ECM 10. In this case, there is a height difference corresponding to the thickness of the crimp edge 11*a* between the outer surface of the crimp edge 11*a* and outer surface of the circuit board 14 on which the electrode patterns are formed. That is, the crimp edge 11*a* protrudes from the outer surface of the circuit board 14. Consequently, when the ECM 10 is placed on a surface of the mounting board, the crimp edge 11*a* touches the surface of the mounting board, thereby preventing the outer surface of the circuit board 14 on which the electrode patterns are formed from contacting the surface of the mounting board. With the ECM 10 mounted on the mounting board, electrical connections between the electrode patterns on the outer surface of the circuit board 14 and mounting board are made via solder (the solder bump electrodes 21*a* and 21*b* solidified after being melted by reflow soldering) formed in a gap between the outer surface of the circuit board 14 and the surface of the mounting board.

However, a solder defect rate generally increases with increasing distance between the electrodes to be soldered. That is, the possibility of solder separation between the outer surface of the circuit board 14 of the ECM 10 and the surface of the mounting board increases with increases in the gap between them, resulting in an increased solder defect rate.

The present invention has been made in view of the above circumstances and has an object to provide an ECM which can prevent solder separation from a surface of a mounting board and thereby reduce a solder defect rate.

Means to Solve Issues

To solve the above issues, the present invention provides an ECM, comprising: a vibrating diaphragm and a back electrode which compose a condenser; a cylindrical case which houses the vibrating diaphragm and the back electrode; a circuit board which is housed in an opening of the cylindrical case, is fixed to the opening by crimping a crimp edge formed by bending an opening end of the cylindrical case inward, and covers the opening; and a substrate fastened to an outer surface of the circuit board, wherein terminal electrode patterns are formed on the outer surface of the circuit board, first substrate electrode patterns are formed on that surface of the substrate which is farther from the circuit board, the terminal electrode patterns and the first substrate electrode patterns are connected with each other via thru-holes in the substrate, and that surface of the substrate on which the first substrate electrode patterns are formed serves as a reflow-soldering surface.

In this way, according to the present invention, the substrate is fastened to the circuit board which is crimped by the crimp edge, and that surface of the fastened substrate on which the first substrate electrode patterns are formed is used as a reflow-soldering surface. This reduces the distance between the reflow-soldering surface and a mounting board surface, thereby reducing solder separation between them and increasing efficiency percentage of soldering. The configuration of the present invention can be implemented by fastening a substrate of typical shape to the circuit board. The configuration of the present invention can be implemented by simply fastening the predetermined substrate to an ECM of a conventional configuration. This means that the present invention can be introduced with little new capital investment, design change, or the like.

In the present invention, preferably thickness of the substrate is larger than height of the crimp edge from the outer surface of the circuit board. This allows the reflow-soldering surface of the substrate to protrude from the crimp edge, and thus prevents the crimp edge from touching the mounting board and thereby forming a gap between the reflow-soldering surface of the substrate and the mounting board. Consequently, the solder defect rate of the ECM is reduced further.

In the present invention, preferably the substrate has through-holes which connect a space enclosed by the circuit board, substrate, and electrode patterns formed between the circuit board and substrate with external space. This prevents air sealed in the space enclosed by the circuit board, substrate, and electrode patterns formed between them from expanding with heat during reflow and thereby causing solder defects, deformation of the circuit board, or the like.

In the present invention, preferably part of the substrate is located outside flanks of the cylindrical case and a marking which indicates orientation of the ECM is formed in the part of the substrate located outside the flanks of the cylindrical case. This makes it possible to check the orientation of the ECM easily when mounting it.

EFFECTS OF THE INVENTION

Thus, the present invention can increase the efficiency percentage in the soldering process of ECMs.

DESCRIPTION OF SYMBOLS

Figure 1:
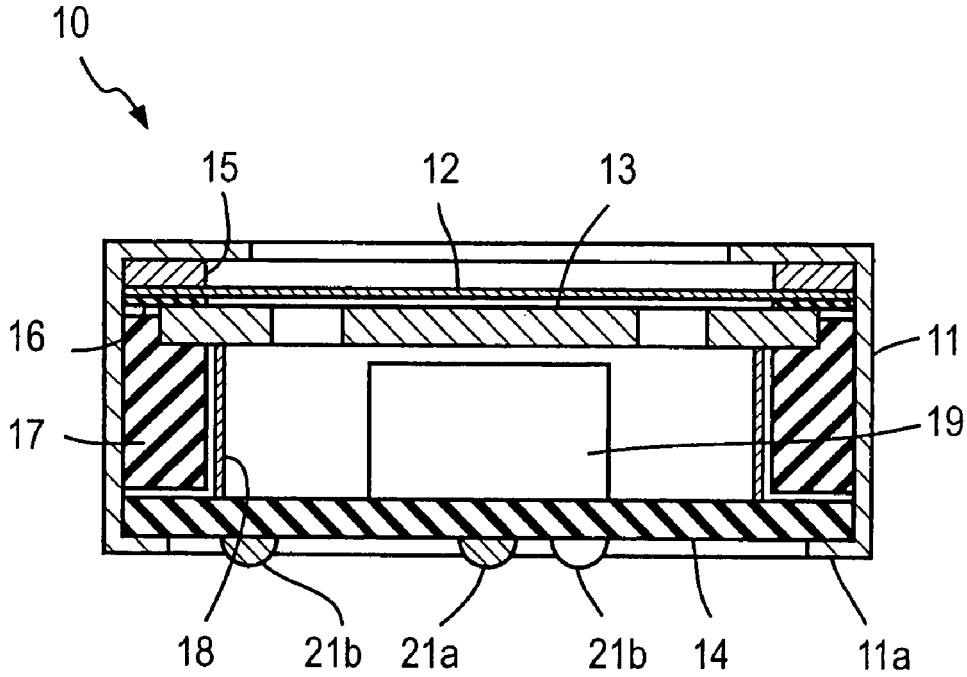
FIG. 1 is a sectional view showing a conventional configuration example of an electret-condenser microphone which lends itself to reflow soldering.

10, 30, 70, 90, 130, 160: ECM (electret-condenser microphone)
11, 31: Cylindrical case
11*a*, 31*b*: Crimp edge
12: Vibrating diaphragm
13: Back electrode
14: Circuit board
15, 18, 34, 41: Ring
17, 42: Holder
16, 36: Insulating spacer
19: Circuit element
21*a*, 21*b*, 47*a*, 47*b*: Solder bump electrode
31*a*: End face
31*c*: Opening
32: Through-hole
33: Vibrating diaphragm
35: Back electrode
37: Electret diaphragm
38: Through-hole
39, 239: Circuit board
42*a*: Shoulder
44, 52, 55, 85, 105, 122, 164, 244: Circular pattern
45, 53, 56, 86, 106, 123, 165, 245: Annular pattern
51, 81, 101, 121, 141, 142, 143: Substrate
54*a*, 54*b*, 84*a*, 84*b*, 144*a*, 144*b*, 250: Thru-hole
57, 87, 147: Through-hole
82: Earth terminal pattern
83, 103: Output terminal pattern
84*aa*, 84*ba*: Electrode
89, 104: Marking
164*a*, 165*a*: Protruding surface
166: Slit
244*a*, 245*a*: Protruding surface

BEST MODES FOR CARRYING OUT THE INVENTION

Embodiments of the present invention will be described below with reference to the drawings.

First Embodiment

A first embodiment of the present invention will be described first. This embodiment will be described by citing an ECM of a back electret type as an example.

Figure 2A:
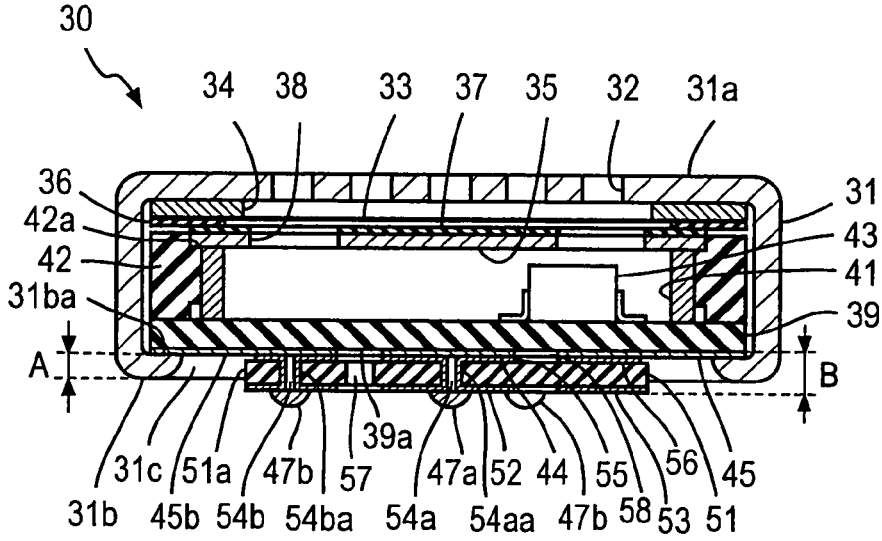
FIG. 2A is a sectional view taken along line 2A-2A in FIG. 2B.
Figure 2B:
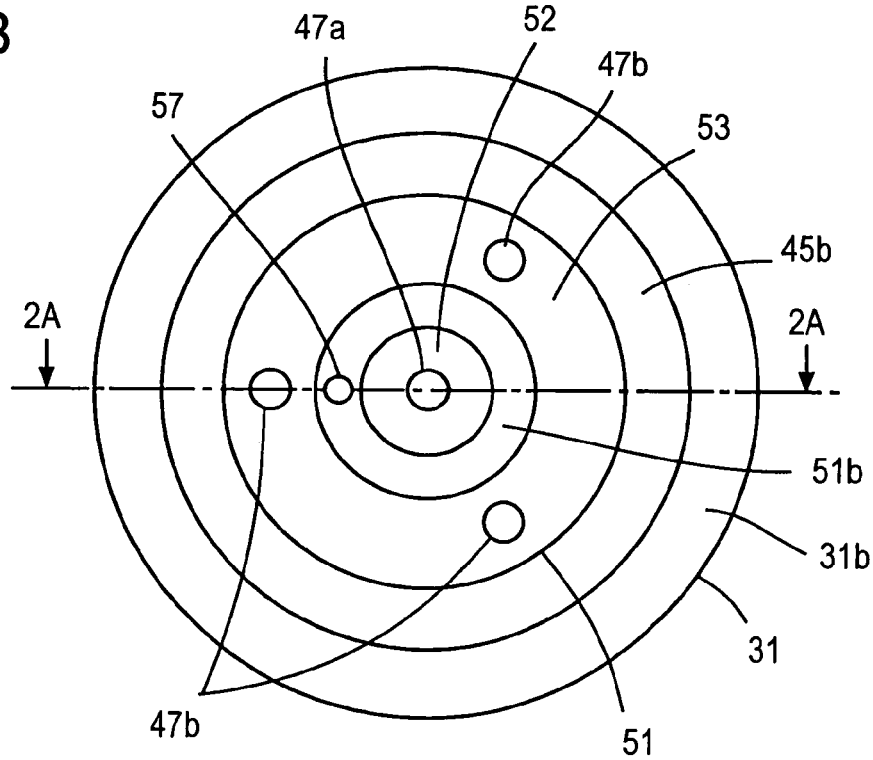
FIG. 2B is a bottom view of the ECM.
Figure 3A:
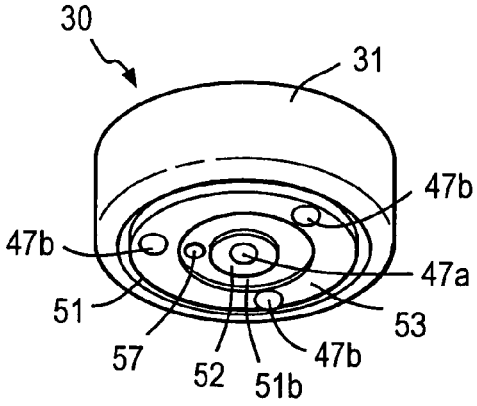
FIG. 3A is a perspective view of the ECM as viewed obliquely from below.
Figure 3B:
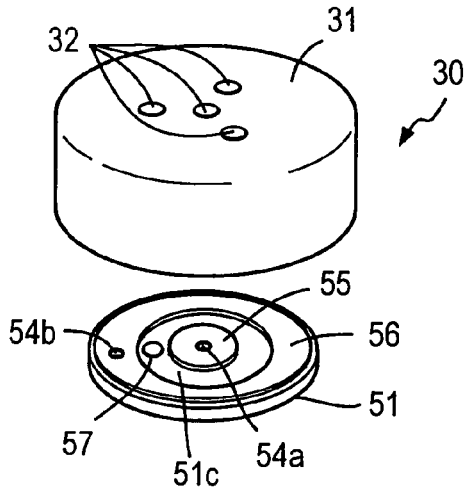
FIG. 3B is an exploded view of a substrate of the ECM.
Figure 4A:
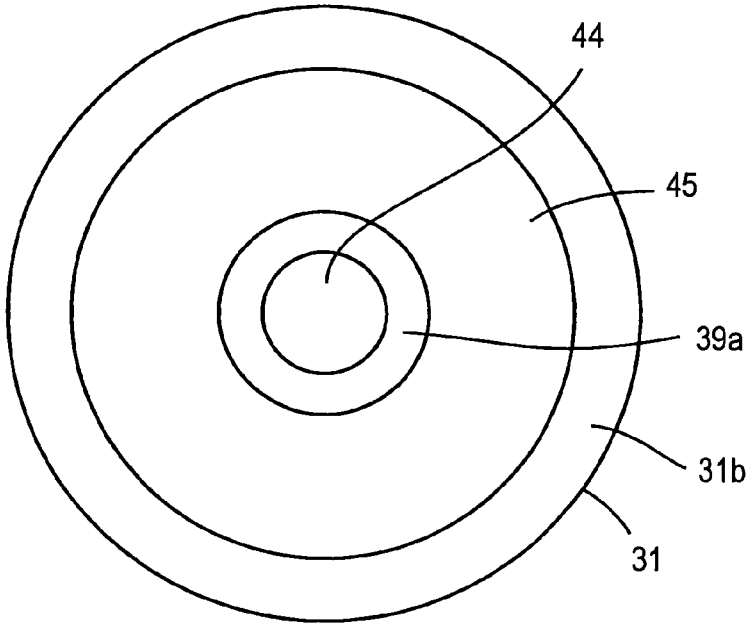
FIG. 4A is a bottom view of a case with the substrate removed from the ECM.
Figure 4B:
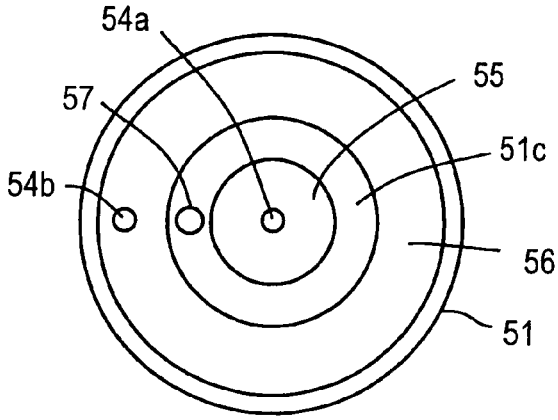
FIG. 4B is a top view of the removed substrate.

FIGS. 2 to 4 are diagrams illustrating a configuration of an ECM 30 according to this embodiment. FIG. 2A is a sectional view taken along line 2A-2A in FIG. 2B and FIG. 2B is a bottom view of the ECM 30. FIG. 3A is a perspective view of the ECM 30 as viewed obliquely from below and FIG. 3B is an exploded view of a substrate of 51 the ECM 30. FIG. 4A is a bottom view of a cylindrical case 31 with the substrate 51 removed from the ECM 30 and FIG. 4B is a top view of the removed substrate 51.

As illustrated in FIGS. 2 to 4, the ECM 30 according to this embodiment has a cylindrical case 31, a vibrating diaphragm 33, a ring 34, a back electrode 35, an insulating spacer 36, an electret diaphragm 37, a circuit board 39, a ring 41, a holder 42, a FET (field-effect transistor) 43, solder bump electrodes 47*a* and 47*b*, and a substrate 51.

The cylindrical case 31 in this example is cylindrical in shape and has one end face closed. A plurality of through-holes 32 are formed in the closed end face 31*a*. Incidentally, the cylindrical case 31 in this example is made of metal such as aluminum.

The ring 34 made of metal such as brass or stainless steel is placed on the inside edge of the cylindrical case 31 nearer to the end face 31*a* with one end kept in intimate contact with the inner surface of the end face 31*a*. The vibrating diaphragm 33 is placed on the other end of the ring 34, where the vibrating diaphragm 33 is a conductive film with a conductive layer formed by vapor-depositing metal film on one surface of PPS (poly phenylene sulfide) or other polymer film. Incidentally, the vibrating diaphragm 33 in this example is placed approximately parallel to the end face 31*a* at a position facing the through-holes 32, with its peripheral edge on one side (the metal-film side) kept in intimate contact with one end of the ring 34. The back electrode 35 consisting of a plate made of metal such as brass or stainless steel is placed on that side of the vibrating diaphragm 33 which is farther from the ring 34 via the ring-shaped insulating spacer 36 (made of PI (polyimide) or other heat-resistant polymer). Incidentally, a through-hole 38 is formed in the back electrode 35. Also, the electret diaphragm 37 made of PTFE (polytetrafluorethylene) or other polymer material is formed on that surface of the vibrating diaphragm 33 which is nearer to the back electrode 35. The vibrating diaphragm 33 and back electrode 35 are placed approximately parallel to each other, forming a condenser in which they function as electrodes.

A disk-shaped circuit board 39 is housed in an opening 31*c* of the cylindrical case 31 (at the end opposite to the end face 31*a*). Incidentally, the circuit board 39 consists of an insulating substrate of glass epoxy or the like with predetermined electrode patterns formed on both sides by copper plating or the like. In this example, a circular pattern 44 and annular pattern 45 (collectively referred to as "terminal electrode patterns," according to this embodiment) are formed on the outer surface of the circuit board 39. The circular pattern 44 is a circular electrode pattern formed in the central part of the outer surface of the circuit board 39 while the annular pattern 45 is an annular terminal electrode pattern enclosing the outer periphery of the circular pattern 44 (see FIGS. 2A and 4A) at a certain distance. Electrode patterns which constitute predetermined circuits are formed on the inner surface of the circuit board 39 in this example by copper plating or the like although they are not shown. Incidentally, the circular pattern 44 and annular pattern 45 are electrically continuous to corresponding electrode patterns on the inner surface of the circuit board 39 via respective thru-holes (not shown).

The cylindrical ring 41 made of metal such as brass or stainless steel is interposed between the circuit board 39 and back electrode 35. The electrode patterns formed on the inner surface of the circuit board 39 are electrically continuous to the back electrode 35 via the ring 41. Besides, a space is formed, being enclosed by the ring 41, circuit board 39, and back electrode 35. Also, on the side of the space, the FET 43 for impedance conversion and other circuit elements (part of them are omitted from FIG. 2A) are mounted on electrode patterns (not shown) on the inner surface of the circuit board 39.

The cylindrical holder 42 made of PPA (polyphthalamide), LCP (liquid crystalline polymer), or other polymer is placed around the outer periphery of the ring 41 (i.e., the ring 41 is inserted in the holder 42). That end of the holder 42 which is nearer to the circuit board 39 is placed in contact with the inner edge of the circuit board 39. That end of the holder 42 which is nearer to the back electrode 35 holds an outer corner (the corner nearer to the circuit board 39) of the back electrode 35 by means of a shoulder 42*a* provided in its inner circumference. Consequently, the back electrode 35 is positioned and fixed to the holder 42.

The circuit board 39 is fixed to the cylindrical case 31 by crimping a crimp edge 31*b* formed by folding the open end of the cylindrical case 31 inward, after housing the ring 34 with the vibrating diaphragm 33 fastened, insulating spacer 36, back electrode 35 with the electret diaphragm 37 formed on it, holder 42, ring 41, and circuit board 39 in the cylindrical case 31. By crimping, the peripheral edge of the circuit board 39 is held between an open-end tip 31*ba* of the cylindrical case 31 and the holder 42, holding the open-end tip 31*ba* in pressing contact with the annular pattern 45. Consequently, the circuit board 39 is fixed to the opening 31*c*, covering the opening 31*c* (see FIG. 2A).

The substrate 51 is affixed to the outer surface of the circuit board 39.

The substrate 51 in this example is a disk-shaped substrate made of an insulator such as glass epoxy. It is smaller in size (diameter) than an area enclosed by the crimp edge 31*b* on the outer surface of the circuit board 39 (see FIGS. 2 and 3). A circular pattern 55 and annular pattern 56 (collectively referred to as the "second substrate electrode patterns," according to this embodiment) are formed on that surface of the substrate 51 which is nearer to the circuit board 39 (see FIGS. 2A, 3B, and 4B). The circular pattern 55 is a circular electrode pattern formed in the central part of that surface of the substrate 51 which is nearer to the circuit board 39 while the annular pattern 56 is an annular electrode pattern enclosing the outer periphery of the circular pattern 55 at a certain distance.

A circular pattern 52 and annular pattern 53 (collectively referred to as the "first substrate electrode patterns," according to this embodiment) are formed on that surface of the substrate 51 which is farther from the circuit board 39 (see FIGS. 2 and 3A). The circular pattern 52 is a circular electrode pattern formed in the central part of that surface of the substrate 51 which is farther from the circuit board 39 while the annular pattern 53 is an annular electrode pattern enclosing the outer periphery of the circular pattern 52 at a certain distance. In this example, the circular pattern 52 and circular pattern 55 as well as the annular pattern 53 and annular pattern 56 are formed on opposite sides of the substrate 51. Incidentally, no electrode pattern is formed on a flank 51*a* of the substrate 51 and the flank 51*a* acts as an insulator.

Furthermore, the substrate 51 has a thru-hole 54*a* passing from the circular pattern 55 to the circular pattern 52 and a thru-hole 54*b* passing from the annular pattern 56 to the annular pattern 53. Besides, an inner-wall electrode 54*aa* is formed on an inner wall of the thru-hole 54*a* while an inner-wall electrode 54*ba* is formed on an inner wall of the thru-hole 54*b*. With this configuration, the circular pattern 55 and circular pattern 52 are electrically connected via the inner-wall electrode 54*aa* on the inner wall of the thru-hole 54*a* while the annular pattern 56 and annular pattern 53 are electrically connected via the inner-wall electrode 54*ba* on the inner wall of the thru-hole 54*b* (see FIG. 2A).

Also, the substrate 51 has a through-hole 57 passing from an area 51*b* between the circular pattern 52 and annular pattern 53 to an area 51*c* between the circular pattern 55 and annular pattern 56 (see FIGS. 2 to 4).

Incidentally, the thru-holes 54*a* and 54*b*, through-hole 57, circular patterns 52 and 55, annular patterns 53 and 56, and inner-wall electrodes 54*aa* and 54*ba* are formed, for example, as follows. First, the thru-holes 54*a* and 54*b* are formed in the substrate 51 by drilling, laser machining, or the like. Next, the surfaces of the substrate 51 are masked by photolithography or the like except for the part where the circular patterns 52 and 55 and annular patterns 53 and 56 will be formed. The masked substrate 51 is copper-plated or the like to form the circular patterns 52 and 55, annular patterns 53 and 56, and inner-wall electrodes 54*aa* and 54*ba*. After the mask is removed, the through-hole 57 is formed by drilling, laser machining, or the like.

The substrate 51 configured as described above is fastened to the outer surface of the circuit board 39 excluding the outer periphery of the outer surface of the circuit board 39, for example, by solder, conductive adhesive, or the like at a certain distance from the crimp edge 31*b* (see FIGS. 2A and 3A). Consequently, the circular pattern 55 on the substrate 51 is electrically connected with the circular pattern 44 on the circuit board 39 while the annular pattern 56 on the substrate 51 is electrically connected with the annular pattern 45 on the circuit board 39. Also, a space 58 enclosed by the circuit board 39, substrate 51, and electrode patterns (i.e., the circular patterns 44 and 55 and annular patterns 45 and 56) formed between them is linked with the external space of the ECM 30 via the through-hole 57 in the substrate 51. Incidentally, in this example, the thickness B of the substrate 51 including the circular patterns 52 and 55 and annular patterns 53 and 56 is not smaller than the height A of the crimp edge 31*b* from the crimped surface 45*b* on the outer surface of the circuit board 39 (see FIG. 2A).

In the above configuration, the back electrode 35 is electrically connected with the ring 41, an electrode pattern (not shown) formed on the inner surface of the circuit board 39, a gate terminal of the FET 43, and other circuit elements. It is also electrically connected with the circular pattern 52 which constitutes an output terminal, via a thru-hole (not shown) and the circular patterns 44 and 55 in/on the circuit board 39. Besides, the vibrating diaphragm 33 is electrically connected with the annular pattern 53 which constitutes an earth terminal, via the ring 34, cylindrical case 31, crimp edge 31*b*, annular pattern 45, annular pattern 56, and inner-wall electrode 54*ba*. The outer surface of the substrate 51 on which the circular pattern 52 and annular pattern 53 are formed constitutes a reflow-soldering surface. Consequently, a height difference is produced between the outer surface of the substrate 51 which is the reflow-soldering surface and the crimped surface 45*b* of the circuit board 39 with which the crimp edge 31*b* is held in pressing contact. One solder bump electrode 47*a* is produced at the center location of the circular pattern 52 while three solder bump electrodes 47*b* are produced at 120-degree intervals on the annular pattern 53. The solder bump electrodes 47*a* and 47*b* are formed, for example, by printing. Incidentally, the number of solder bump electrodes 47*b* is not limited to three and may be four or more. However, the formation of three solder bump electrodes 47*b* as in this example makes it possible to place the ECM 30 horizontally on a wiring pattern on the mounting board in a stable manner.

Figure 5:
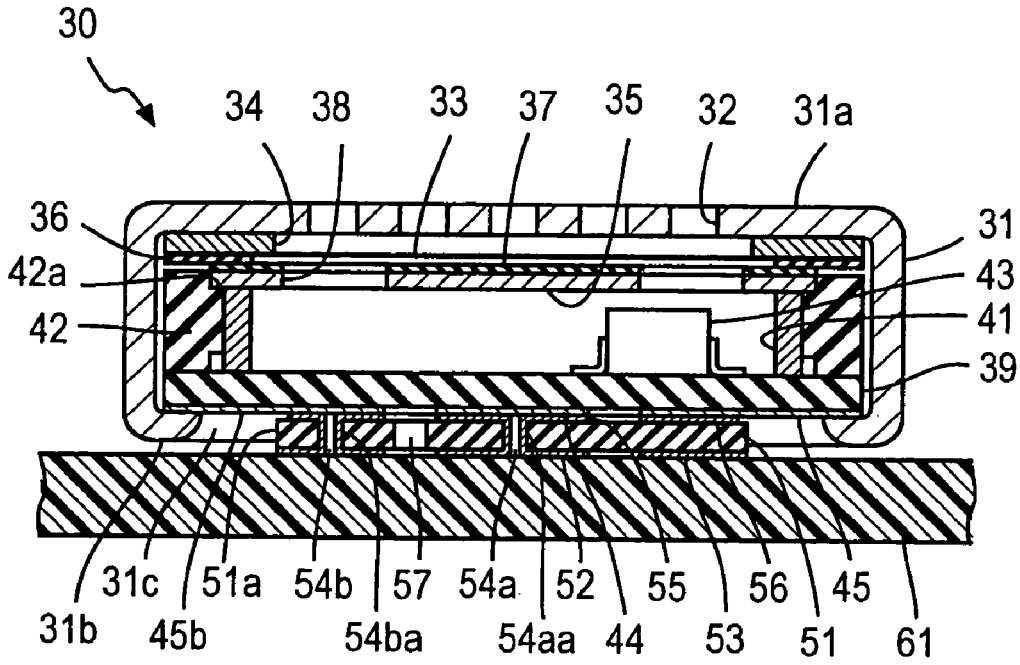
FIG. 5 is a sectional view showing the ECM mounted on a mounting board by reflow soldering.

FIG. 5 is a sectional view showing the ECM 30 mounted on a target mounting board 61 by reflow soldering.

In this example, a solder layer is formed on a wiring pattern (not shown) on the mounting board 61. The solder bump electrodes 47*a* and 47*b* of the ECM 30 are placed on the solder layer and reflow soldering is performed by heating the solder to fusion in a reflow furnace. Incidentally, it is not strictly necessary to form the solder bump electrodes 47*a* and 47*b* because with the configuration in this example, the reflow-soldering surface itself protrudes from the crimp edge 31*b*. Therefore, it is alternatively possible to deposit solder paste at three or more locations on the target mounting board by means of a metal mask and mount the ECM 30 on the mounting board 61 using the solder paste.

In this example, as shown in FIG. 5, being formed on the substrate 51 fastened to the outer surface of the circuit board 39, both the circular pattern 52 which constitutes the output terminal for external connection and annular pattern 53 which constitutes the earth terminal serve as reflow-soldering surfaces. That is, the reflow-soldering surfaces protrude from the crimp edge 31*b* of the cylindrical case 31. This prevents the crimp edge 31*b* from hitting a board surface of the mounting board 61 and thereby lifting the solder joint surface. Consequently, the ECM 30 can be reflow-soldered properly. That is, automatic reflow soldering can be performed with a low defect rate, improving productivity in that respect.

Also, in this example, since the outer surface of the substrate 51 fastened to the outer surface of the circuit board 39 serves as a reflow-soldering surface, conduction of solder-melting heat to the ECM 30 can be reduced. This makes it possible to prevent performance degradation and breakage of the ECM 30.

Furthermore, if the space 58 between the circular pattern 44 and the annular pattern 45 around it is sealed during reflow, thermal expansion of air may cause solder defects, deformation of the circuit board 39, or the like. Deformation of the circuit board 39 can cause a poor connection between the circuit board 39 and the ring 41 for electrical connection as well as sensitivity variations or poor sensitivity (performance degradation) due to distortion in the ECM 30. In this example, however, the through-hole 57 made in the substrate 51 connecting the space 58 with the world outside the substrate 51 provides an escape route for the air in the space 58, making it possible to prevent solder defects, deformation of the circuit board 39, etc. caused by thermal expansion of the air.

Also, in this example, there is a height difference between the outer surface of the substrate 51 which is the reflow-soldering surface and the crimped surface 45*b* of the circuit board 39 with which the crimp edge 31*b* is held in pressing contact. The existence of the vertical height difference and increase in creepage distance from the reflow-soldering surface to the crimp edge 31*b* can prevent solder and flux which flow out of the reflow-soldering surface from flowing into the ECM 30. This makes it possible to avoid performance degradation of the ECM 30 and failure of the ECM 30 to operate normally, which would be caused if solder and flux flowed into the ECM 30.

Also, in this example, a step face existing between the reflow-soldering surface and the crimped surface 45*b* is formed by the flank 51*a* of the substrate 51 which is an insulator. Generally, insulators have low solder wettability. Thus, in this example, the flank 51*a* blocks the inflow of solder from the reflow-soldering surface into the ECM 30 more properly.

The configuration in this example can be implemented by simply fastening the substrate 51 to the circuit board 39. For example, it can be implemented by simply fastening the substrate 51 to an ECM of a conventional configuration. This means that the ECM 30 of the present configuration can be introduced with little new capital investment, design change, or the like. Also, the ECM 30 with this simple configuration involves low manufacturing costs.

Second Embodiment

Next, a second embodiment of the present invention will be described.

This embodiment is a modification to the first embodiment. The following description will focus on differences from the first embodiment and description of common items will be omitted.

Figure 6A:
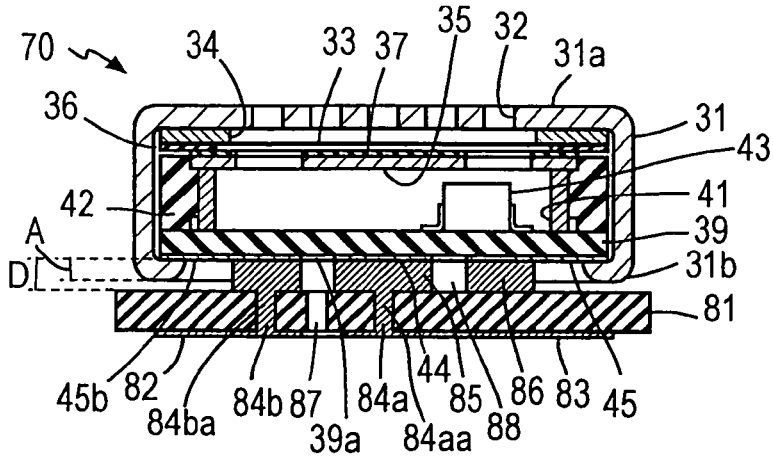
FIG. 6A is a sectional view taken along line 6A-6A in FIG. 6B.
Figure 6B:
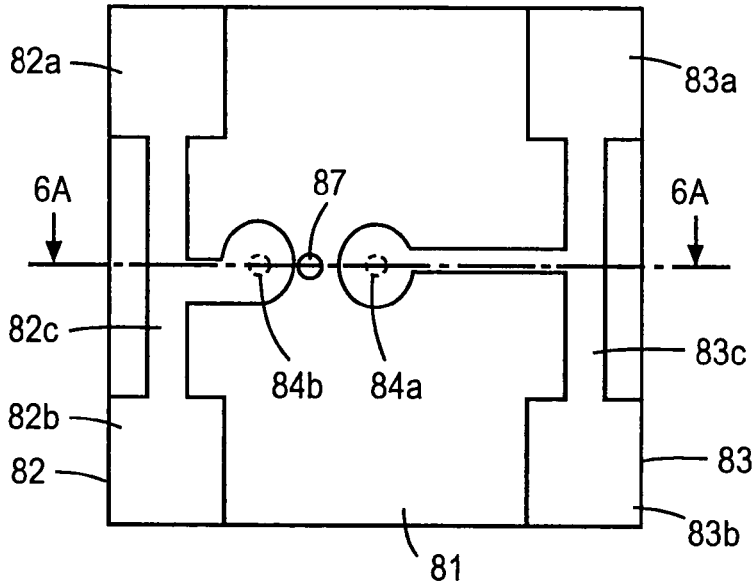
FIG. 6B is a bottom view of an ECM.
Figure 6C:
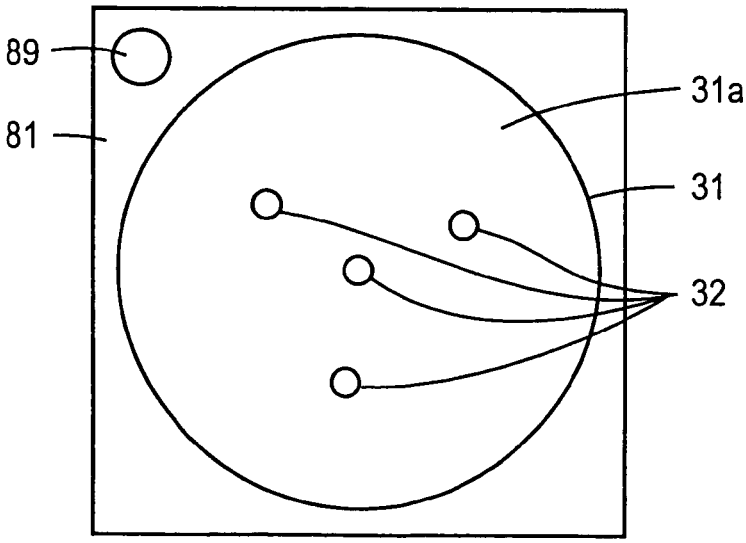
FIG. 6C is a top view of the ECM.
Figure 7A:
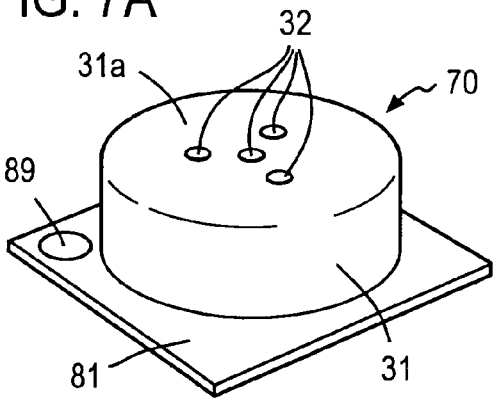
FIG. 7A is a perspective view of the ECM as viewed obliquely from above.
Figure 7C:
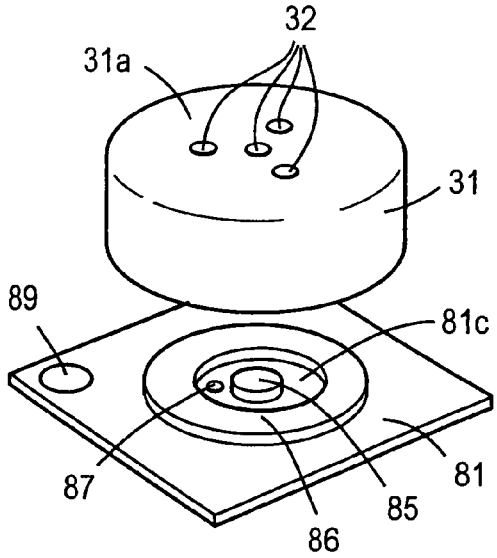
FIG. 7C is an exploded view of a substrate of the ECM.
Figure 7B:
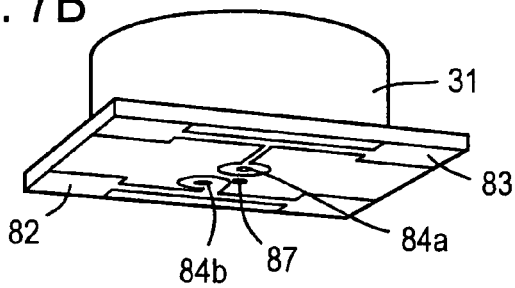
FIG. 7B is a perspective view of the ECM as viewed obliquely from below.
Figure 8:
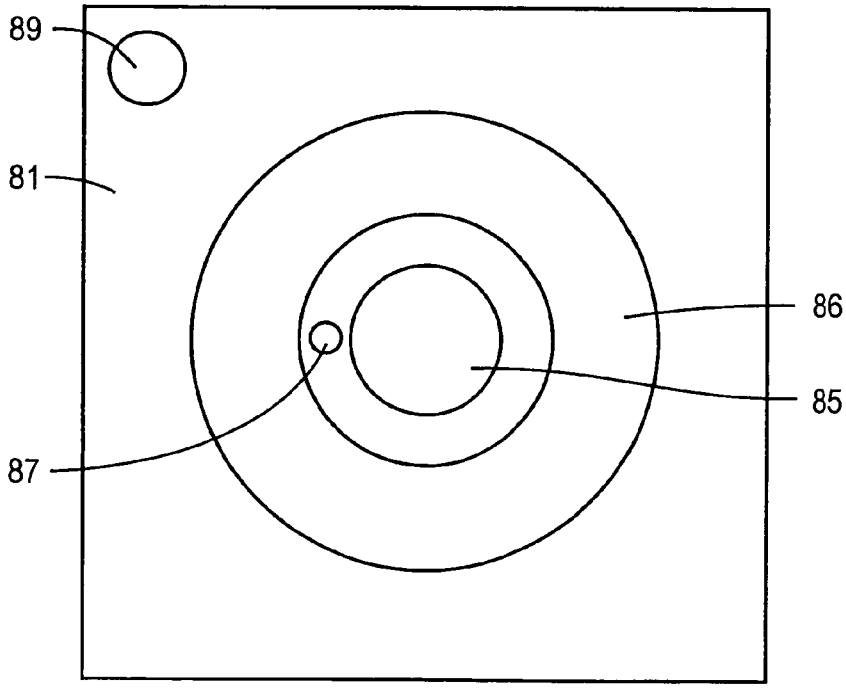
FIG. 8 is a top view of the substrate removed from the ECM.

FIGS. 6 to 8 are diagrams showing a configuration of an ECM 70 according to this embodiment. FIG. 6A is a sectional view taken along line 6A-6A in FIG. 6B, FIG. 6B is a bottom view of the ECM 70, and FIG. 6C is a top view of the ECM 70. FIG. 7A is a perspective view of the ECM 70 as viewed obliquely from above, FIG. 7B is a perspective view of the ECM 70 as viewed obliquely from below, FIG. 7C is an exploded view of a substrate 81 of the ECM 70. FIG. 8 is a top view of the substrate 81 removed from the ECM 70. The same components as those in the first embodiment are denoted by the same reference numerals as the corresponding components in the first embodiment.

As shown in FIGS. 6 to 8, the ECM 70 according to this embodiment has a cylindrical case 31, vibrating diaphragm 33, ring 34, back electrode 35, insulating spacer 36, electret diaphragm 37, circuit board 39, ring 41, holder 42, FET 43, and substrate 81. Incidentally, the cylindrical case 31, vibrating diaphragm 33, ring 34, back electrode 35, insulating spacer 36, electret diaphragm 37, circuit board 39, ring 41, holder 42, and FET 43 of the ECM 70 are the same as those of the first embodiment, and thus description thereof will be omitted.

The ECM 70 according to this embodiment also has a configuration in which the substrate 81 is affixed to the outer surface of the circuit board 39.

The substrate 81 in this example is an angular substrate made of an insulator such as glass epoxy. Its size is larger than the area of the end face 31*a* of the cylindrical case 31 (see FIGS. 6 to 8). A circular pattern 85 and annular pattern 86 (collectively referred to as the "second substrate electrode patterns," according to this embodiment) are formed on that surface of the substrate 81 which is nearer to the circuit board 39 (see FIGS. 6A, 7C, and 8). The circular pattern 85 is a circular electrode pattern formed in the central part of that surface of the substrate 81 which is nearer to the circuit board 39 while the annular pattern 86 is an annular electrode pattern enclosing the outer periphery of the circular pattern 85 at a certain distance. A difference from the first embodiment lies in that the thickness D of both annular pattern 86 and circular pattern 85 is not smaller than the height A of the crimp edge 31*b* from the crimped surface 45*b* on the outer surface of the circuit board 39 (see FIG. 6A).

Also, thru-holes 84*a* and 84*b* are formed in the substrate 81, starting from locations of the circular pattern 85 and annular pattern 86 and penetrating the substrate 81. The thru-holes 84*a* and 84*b* are filled with electrodes 84*aa* and 84*ba* which are electrically continuous to the circular pattern 85 and annular pattern 86, respectively.

An earth terminal pattern 82 which is electrically continuous to the electrode 84*ba* and output terminal pattern 83 which is electrically continuous to the electrode 84*aa* (collectively referred to as the "first substrate electrode patterns," according to this embodiment) are formed on that surface of the substrate 81 which is farther from the circuit board 39 (see FIGS. 6B and 7B). As shown in FIG. 6B, the earth terminal pattern 82 consists of a rectangular electrode 82*a* formed in one corner of the given surface, a rectangular electrode 82*b* formed in another corner of the given surface, and a wiring electrode 84*b* which links the electrodes 82*a* and 82*b* with a thru-hole 82*c*. On the other hand, the output terminal pattern 83 consists of a rectangular electrode 83*a* formed in one corner of the given surface, a rectangular electrode 83*b* formed in another corner of the given surface, and a wiring electrode 83*c* which links the electrodes 83*a* and 83*b* with a thru-hole 84*a*. As shown in FIG. 6B and the like, the electrodes 82*a*, 82*b*, 83*a*, and 83*b* are formed in contact with edges of the substrate 81.

As shown in FIGS. 6 to 8, the substrate 81 has a through-hole 87 penetrating it from an area 81*c* between the circular pattern 85 and annular pattern 86 (see FIG. 7C) to such a location on the back of the substrate 81 that is clear of the earth terminal pattern 82 and output terminal pattern 83.

Furthermore, as shown in FIGS. 6C, 7A, 7B, and 8, a marking 89 is formed in one corner on that surface of the substrate 81 on which the circular pattern 85 and annular pattern 86 are formed. The marking 89 may be created by drawing it with a paint or the like or engraving it in the surface of the substrate 81. Also, as illustrated in FIG. 6C, part of the substrate 81 of the ECM 70 according to this embodiment is located outside the flanks of the cylindrical case 31. The marking 89 is provided in the part located outside the flanks of the cylindrical case 31, making it possible to identify the orientation of the ECM 70 (orientation in rotational direction around an axis perpendicular to FIG. 6C) as viewed from the end face 31*a*.

Incidentally, the thru-holes 84*a* and 84*b*, through-hole 87, circular pattern 85, annular pattern 86, earth terminal pattern 82, output terminal pattern 83, and electrodes 84*aa* and 84*ba* are formed, for example, as follows.

First, the thru-holes 84*a* and 84*b* are formed in the substrate 81 made of glass epoxy or the like. Next, the surfaces of the substrate 81 are masked except for the part where the circular pattern 85, annular pattern 86, earth terminal pattern 82, and output terminal pattern 83 will be formed. Then, the substrate 81 is copper-plated until the earth terminal pattern 82 and output terminal pattern 83 are formed to desired thickness. Consequently, the earth terminal pattern 82 and output terminal pattern 83 as well as part of the circular pattern 85, annular pattern 86, and electrodes 84*aa* and 84*ba* are formed on the substrate 81. Leaving the previous mask as it is, a mask is newly formed to cover the earth terminal pattern 82 and output terminal pattern 83. Then, the substrate 81 is copper-plated until the circular pattern 85 and annular pattern 86 obtain desired thickness, to complete the circular pattern 85, annular pattern 86, and electrodes 84*aa* and 84*ba*. The masks are removed, and then the through-hole 87 is formed.

The substrate 81 configured as described above is fastened to the outer surface of the circuit board 39 via the circular pattern 85 and annular pattern 86, for example, by solder, conductive adhesive, or the like (see FIG. 6A). Consequently, the circular pattern 85 on the substrate 81 is electrically connected with the circular pattern 44 on the circuit board 39 while the annular pattern 86 on the substrate 81 is electrically connected with the annular pattern 45 on the circuit board 39. Also, a space 88 enclosed by the circuit board 39, substrate 81, and electrode patterns (i.e., the earth terminal pattern 82, output terminal pattern 83, circular pattern 44, the annular pattern 45) formed between them is linked with the external space of the ECM 70 via the through-hole 87 in the substrate 81. In the above configuration, that part of the outer surface of the substrate 81 on which the earth terminal pattern 82 and output terminal pattern 83 are formed serves as a reflow-soldering surface.

With this configuration, the reflow-soldering surface is located outside the crimp edge 31*b* of the cylindrical case 31. This prevents the crimp edge 31*b* from hitting a board surface of the mounting board 61 and thereby lifting the solder joint surface.

In this example again, there is a height difference between the outer surface of the substrate 81 which is the reflow-soldering surface and the crimped surface 45*b* of the circuit board 39 with which the crimp edge 31*b* is held in pressing contact. Furthermore, in this example, since the thickness D of both circular pattern 85 and annular pattern 86 is not smaller than the height A of the crimp edge 31*b* from the crimped surface 45*b* on the outer surface of the circuit board 39, the size of the substrate 81 can be made larger than the area fringed with the crimp edge 31*b*. That is, with the configuration in this example, the substrate 81 can be made larger in size than the substrate 51 according to the first embodiment even though the size of the cylindrical case 31 is constant. This makes it possible to increase the creepage distance from the reflow-soldering surface to the crimp edge 31*b* and thereby block the inflow of solder from the reflow-soldering surface into the ECM 70 more efficiently.

Furthermore, in this example, the angular shape of the substrate 81 improves the manufacturing efficiency of the ECM 70. For example, it is possible to employ a manufacturing method which involves forming a plurality of substrates 81 on a single mother substrate, forming through-holes 87, circular patterns 85, and the like directly, mounting a plurality of cylindrical cases 31, and extracting the ECMs 70 by dicing or trimming the mother substrate. This makes it easier to automate production processes, thereby improving production efficiency.

Also, in this example, both earth terminal pattern 82 and output terminal pattern 83 abut on edges of the substrate 81. Thus, even if the earth terminal pattern 82 or output terminal pattern 83 goes out of contact with the mounting board after the ECM 70 is mounted, repairs can be made by carrying out soldering from a flank of the substrate 81.

Also, in this example, part of the substrate 81 is located outside the flanks of the cylindrical case 31 and the marking 89 which indicates orientation is provided in the part located outside the flanks of the cylindrical case 31. This makes it easy to verify the mounting direction of the ECM 70.

Besides, as in the case of the first embodiment, the configuration of this embodiment makes it possible to reduce conduction of solder-melting heat to the ECM 30; prevent solder defects, deformation of the circuit board 39, etc. caused by thermal expansion of the air; introduce the ECM easily; reduce costs; etc.

Figure 9A:
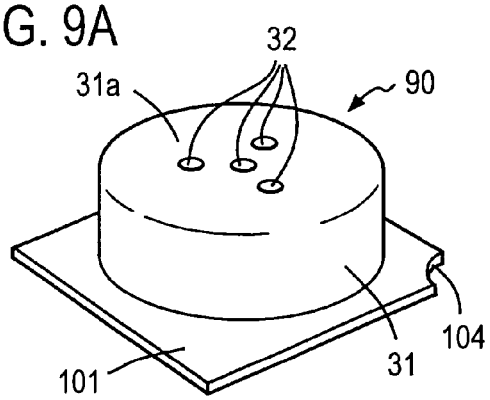
FIG. 9A is a perspective view of an ECM as viewed obliquely from above.
Figure 9C:
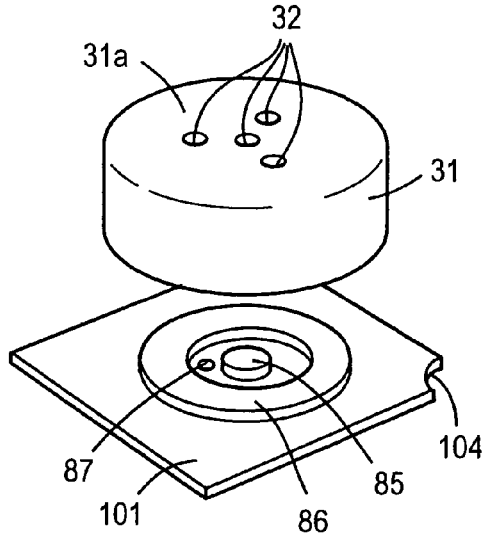
FIG. 9C is an exploded view of a substrate of the ECM.
Figure 9B:
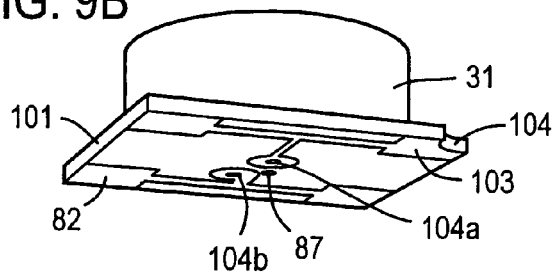
FIG. 9B is a perspective view of the ECM as viewed obliquely from below.

Modifications to this embodiment include one in which the substrate 81 has a different shape or the marking 89 is created by another technique. For example, FIG. 9 shows an ECM 90 in which one corner of a substrate 101 is removed for use as a marking 104. FIG. 9A is a perspective view of the ECM 90 as viewed obliquely from above, FIG. 9B is a perspective view of the ECM 90 as viewed obliquely from below, and FIG. 9C is an exploded view of the substrate 101 of the ECM 90. The configuration of the ECM 90 in this example is the same as that of the ECM 70 described above except that the removed corner of the substrate 101 is used as the marking 104 and that the output terminal pattern 83 is replaced by an output terminal pattern 103.

Figure 10A:
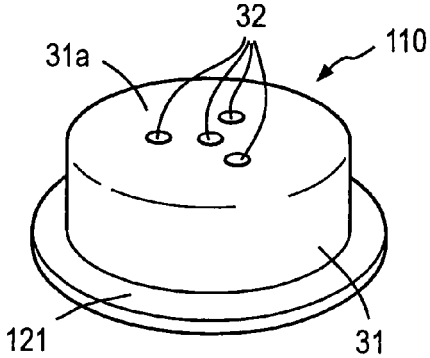
FIG. 10A is a perspective view of an ECM as viewed obliquely from above.
Figure 10C:
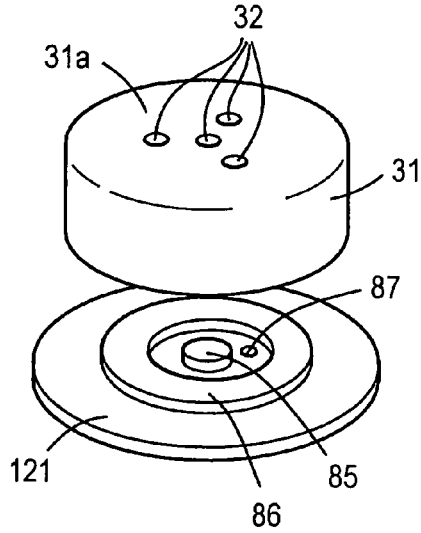
FIG. 10C is an exploded view of a substrate of the ECM.
Figure 10B:
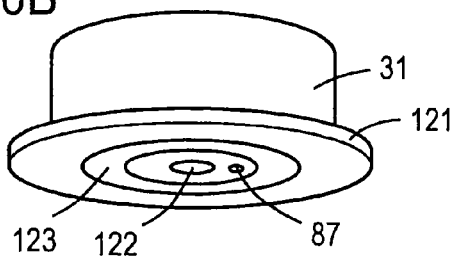
FIG. 10B is a perspective view of the ECM as viewed obliquely from below.

FIG. 10 shows an ECM 110 which employs a disk-shaped substrate 121 instead of the substrate 81. FIG. 10A is a perspective view of the ECM 110 as viewed obliquely from above, FIG. 10B is a perspective view of the ECM 110 as viewed obliquely from below, and FIG. 10C is an exploded view of the substrate 121 of the ECM 110. The configuration of the ECM 110 in this example is the same as that of the ECM 70 described above except that the disk-shaped substrate 121 larger than the end face 31*a* of the cylindrical case 31 is used instead of the substrate 81, that a circular pattern 122 is formed instead of the earth terminal pattern 82, and that an annular pattern 123 is formed instead of the output terminal pattern 83.

Third Embodiment

Next, a third embodiment of the present invention will be described.

This embodiment is a modification to the first embodiment. The following description will focus on differences from the first embodiment and description of common items will be omitted.

Figure 11A:
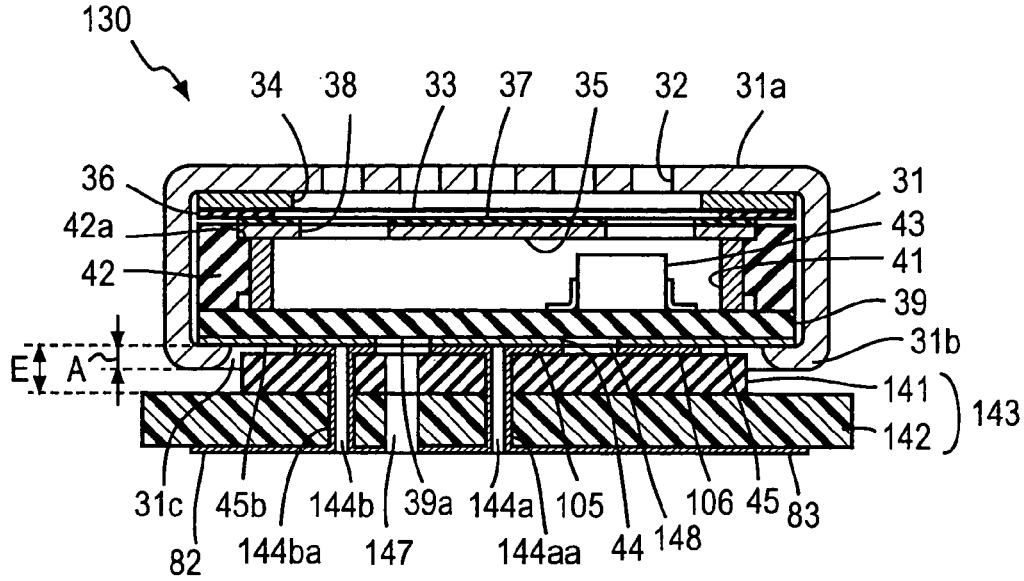
FIG. 11A is a sectional view taken along line 11A-11A in FIG. 11B.
Figure 11B:
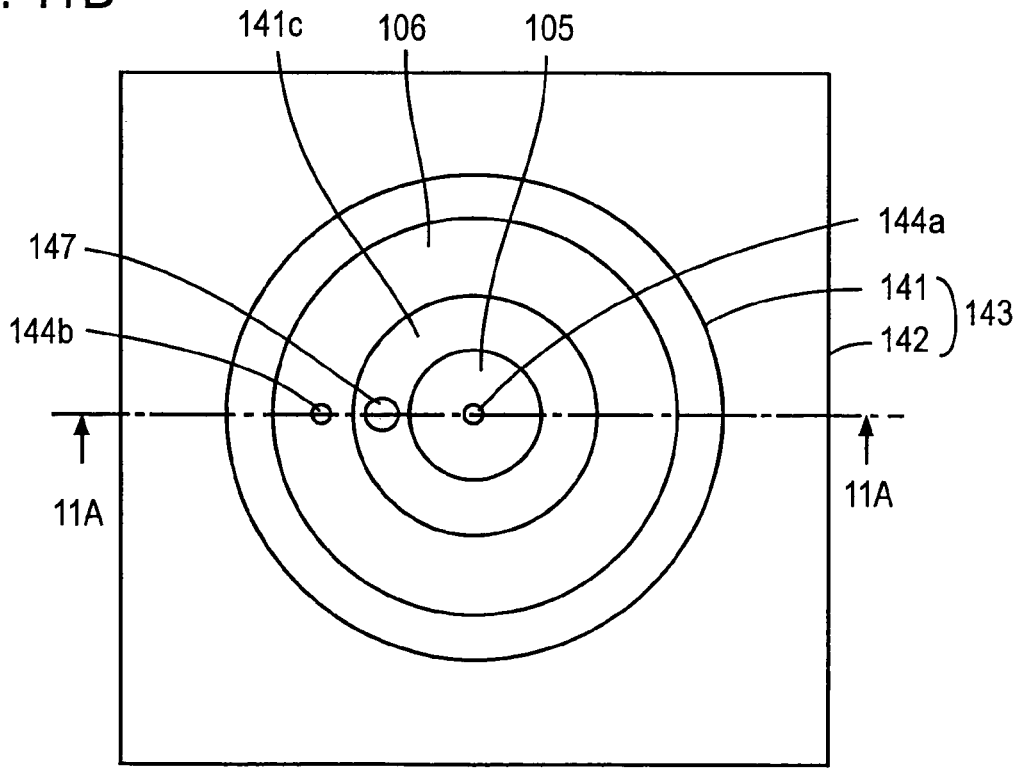
FIG. 11B is a top view of a substrate alone of an ECM.

FIG. 11 is a diagram showing a configuration of an ECM 130 according to this embodiment. FIG. 11A is a sectional view taken along line 11A-11A in FIG. 11B while FIG. 11B is a top view of a substrate 143 alone of the ECM 130.

The ECM 130 according to this embodiment also has a configuration in which the substrate 143 is affixed to the outer surface of the circuit board 39.

The substrate 143 in this example consists of an angular substrate 142 of an insulator such as glass epoxy and a smaller disk-shaped substrate 141 of an insulator pasted together (see FIG. 11). The substrate 142 is larger in size than the area fringed with the crimp edge 31*b*. On the other hand, the substrate 141 is smaller in size than the area fringed with the crimp edge 31*b* (see FIG. 11A). Besides, the thickness E of the substrate 141 is not smaller than the height A of the crimp edge 31*b* from the crimped surface 45*b*.

A circular pattern 105 and annular pattern 106 (collectively referred to as the "second substrate electrode patterns," according to this embodiment) similar to the circular pattern 85 and annular pattern 86 according to the first embodiment are formed on that surface of the substrate 141 which is nearer to the circuit board 39 (see FIG. 11). Also, an earth terminal pattern 82 and output terminal pattern 83 (collectively referred to as the "first substrate electrode patterns," according to this embodiment) similar to those of the second embodiment are formed on that surface of the substrate 142 which is farther from the substrate 141.

Also, the substrate 143 has a thru-hole 144*a* passing through the substrates 141 and 142 from the circular pattern 105 to the output terminal pattern 83 and a thru-hole 144*b* passing through the substrates 141 and 142 from the annular pattern 106 to the earth terminal pattern 82. Besides, inner-wall electrodes 144*aa* and 144*ba* are formed on inner walls of the thru-holes 144*a* and 144*b*, respectively. The annular pattern 106 is electrically continuous to the earth terminal pattern 82 through the inner-wall electrode 144*aa* while the circular pattern 105 is electrically continuous to the output terminal pattern 83 through the inner-wall electrode 144*ba*. Also, as shown in FIG. 11, the substrate 143 has a through-hole 147 which, being located in an area 141*c* between the circular pattern 105 and annular pattern 106, penetrates the substrate 143.

The substrate 141 of the substrate 143 configured as described above is fastened to the outer surface of the circuit board 39, for example, by solder, conductive adhesive, or the like (see FIG. 11A). Consequently, the circular pattern 105 on the substrate 141 is electrically connected with the circular pattern 44 on the circuit board 39 while the annular pattern 106 on the substrate 141 is electrically connected with the annular pattern 45 on the circuit board 39. Also, a space 148 enclosed by the circuit board 39, substrate 141, and electrode patterns formed between them is linked with the external space of the ECM 130 via the through-hole 147 in the substrate 143. In the above configuration, that part of the outer surface of the substrate 142 on which the earth terminal pattern 82 and output terminal pattern 83 are formed serves as a reflow-soldering surface.

The above configuration offers equal or better effects than the first embodiment.

In this example, the size of the substrate 142 can be made larger than the area fringed with the crimp edge 31*b*, as in the case of the second embodiment. This makes it possible to block the inflow of solder and flux from the reflow-soldering surface into the ECM 130 more efficiently.

Fourth Embodiment

Next, a fourth embodiment of the present invention will be described.

This embodiment is a modification to the first embodiment. The following description will focus on differences from the first embodiment and description of common items will be omitted.

Figure 12:
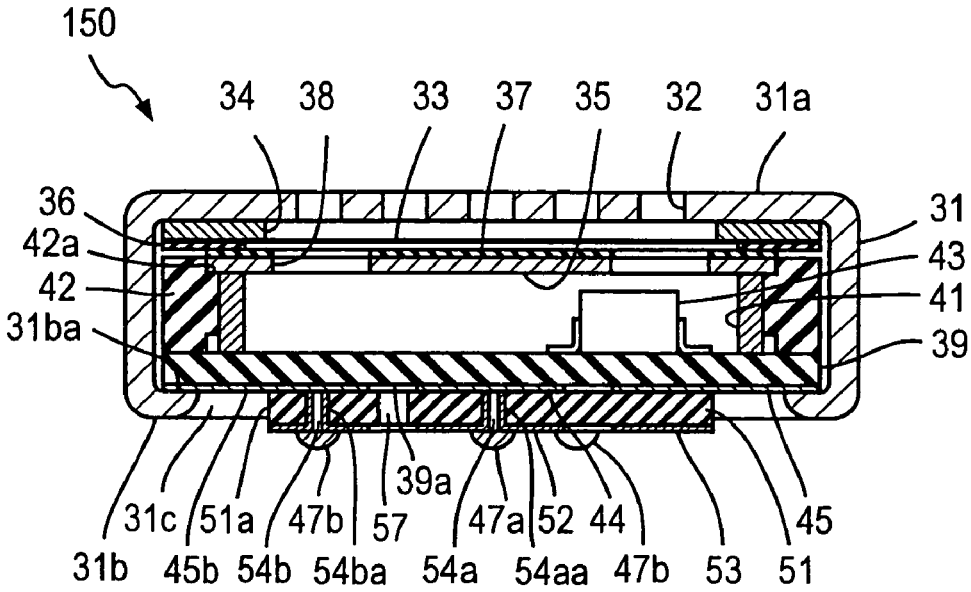
FIG. 12 is a sectional view showing a configuration of an ECM.

FIG. 12 is a sectional view showing a configuration of an ECM 150 according to this embodiment. The same components as those in the first embodiment are denoted by the same reference numerals as the corresponding components in the first embodiment.

The ECM 150 according to this embodiment differs from the ECM 30 according to the first embodiment in that no circular pattern 55 or annular pattern 56 is formed on that surface of the substrate 51 which is nearer to the circuit board 39. The substrate 51 is fastened to the circuit board 39 by solder, conductive adhesive, or the like. However, the only electrodes existing on that surface of the substrate 51 which is nearer to the circuit board 39 are cross sections of inner-wall electrodes 54*aa* and 54*ba* of the thru-holes 54*aa* and 54*ba*. Thus, the inner-wall electrodes 54*a* and 54*b* may be connected both electrically and mechanically to the circular pattern 44 and annular pattern 45 by conductive adhesive instead of fastening the substrate 51 to the circuit board 39 only by solder.

Fifth Embodiment

Next, a fifth embodiment of the present invention will be described.

This embodiment is a modification to the first embodiment. The following description will focus on differences from the first embodiment and description of common items will be omitted.

Figure 13A:
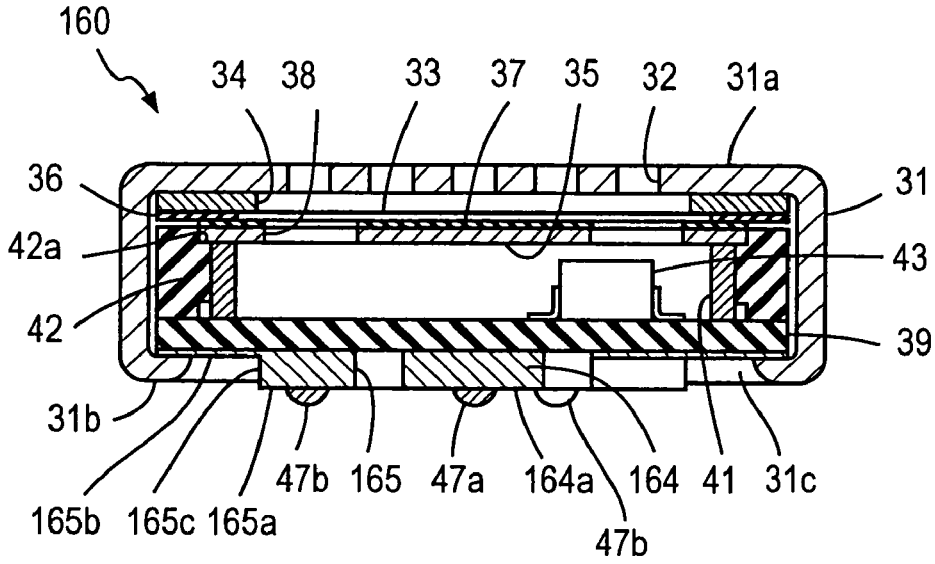
FIG. 13A is a sectional view taken along line 13A-13A in FIG. 13B.
Figure 13B:
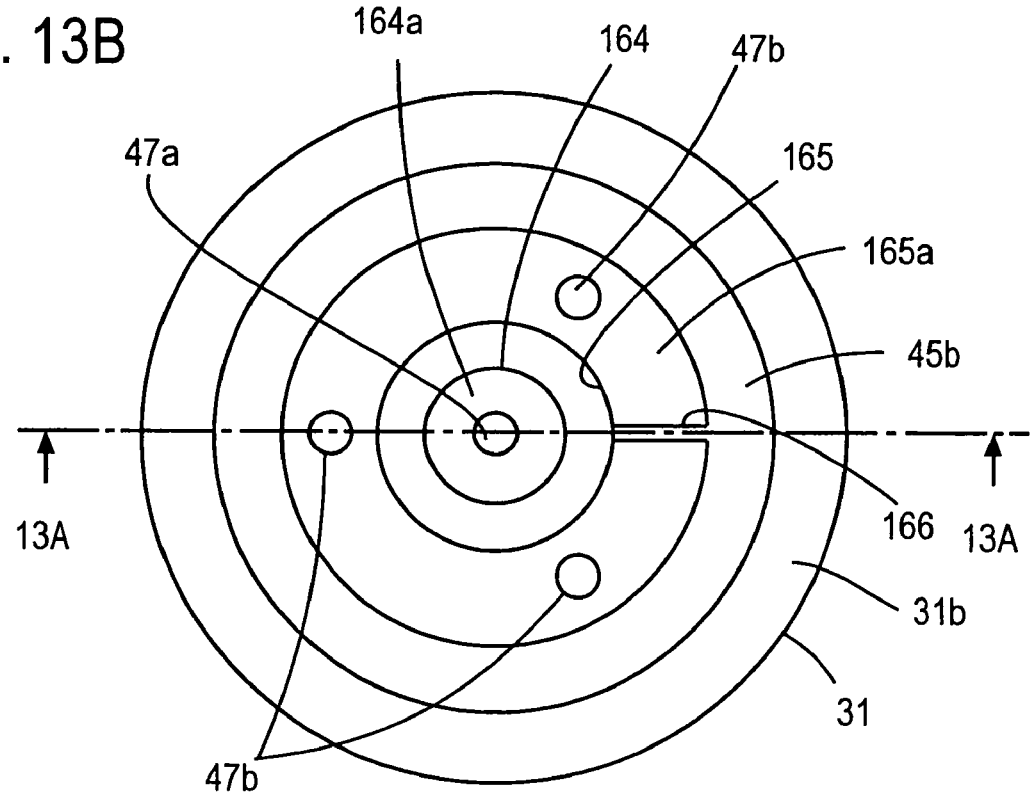
FIG. 13B is a bottom view of an ECM.

FIG. 13 is a diagram showing a configuration of an ECM 160 according to this embodiment. FIG. 13A is a sectional view taken along line 13A-13A in FIG. 13B while FIG. 13B is a bottom view of the ECM 160. The same components as those in the first embodiment are denoted by the same reference numerals as the corresponding components in the first embodiment.

As illustrated in FIG. 13, the ECM 160 according to this embodiment has a cylindrical case 31, a vibrating diaphragm 33, a ring 34, a back electrode 35, an insulating spacer 36, an electret diaphragm 37, a circuit board 39, a ring 41, a holder 42, a FET 43, a circular pattern 164, an annular pattern 165, and solder bump electrodes 47*a* and 47*b*. A major difference from the first embodiment lies in that the ECM 160 does not have a substrate 51, but that the circular pattern 164 and annular pattern 165 protruding from the crimp edge 31*b* serve as reflow-soldering surfaces. The following description will focus on this point.

As illustrated in FIG. 13A, terminal electrode patterns are formed on the outer surface of the circuit board 39. The terminal electrode patterns in this example consist of the circular pattern 164 which constitutes an output terminal and the annular pattern 165 which encloses the circular pattern 164 at a certain distance and constitutes an earth terminal. The circular pattern 164 and annular pattern 165 have protruding surfaces 164*a* and 165*a* whose height is larger than the height (protruding height) of the crimp edge 31*b* of the cylindrical case 31 from the outer surface of the circuit board 39. As illustrated in FIG. 13A, the entire surface of the circular pattern 164 constitutes the protruding surface 164*a* while the annular pattern 165 has the annular protruding surface 165*a* on its inner periphery farther from the crimp edge 31*b*.

A slit 166 is formed in a radial direction in the protruding surface 165*a* of the annular pattern 165. The inner periphery and outer periphery of the annular pattern 165 are communicated with each other via the slit 166. Three solder bump electrodes 47*b* are formed at 120-degree intervals on the protruding surface 165*a* while one solder bump electrode 47*a* is formed at the center location of the protruding surface 164*a* of the circular pattern 164 (as described above, it is not strictly necessary to form the solder bump electrodes 47*a* and 47*b*). The crimp edge 31*b* of the cylindrical case 31 is held in pressing contact with the annular pattern 165, being located on the lower surface of the annular pattern 165, i.e., a thinner crimped surface 165*b* on the outer periphery. The vibrating diaphragm 33 is electrically connected to the annular pattern 165 which constitutes an earth terminal via the ring 34, cylindrical case 31, and crimp edge 31*b*. Incidentally, the annular pattern 165 and circular pattern 164 are electrically continuous to corresponding electrode patterns on the inner surface via respective thru-holes (not shown).

In the above structure, the circular pattern 164 and annular pattern 165 are formed by copper plating and the protruding surfaces 164*a* and 165*a* are formed by increasing the plating thickness. The solder bump electrodes 47*a* and 47*b* are formed, for example, by printing.

The protruding surfaces 164*a* and 165*a* are formed by increasing the plating thickness of the circular pattern 164 and annular pattern 165 as follows.

First, the disk-shaped circuit board 39 is prepared. Next, a mask is formed on the outer surface of the circuit board 39 except for the area where the circular pattern 164 and annular pattern 165 of the shapes illustrated in FIG. 13 will be formed, i.e., the mask is formed in an annular area between the outer peripheral edge of the circular pattern 164 to be formed and inner peripheral edge of the annular pattern 165 to be formed. The circuit board 39 is copper-plated until the plating thickness required for the circular pattern 164 and annular pattern 165 which constitute electrode patterns is obtained. This completes the formation of the circular pattern 164 and annular pattern 165 which are electrode patterns.

Leaving the previous mask as it is, a mask is formed on the annular pattern 165 except for the area where the protruding surface 165*a* will be formed, i.e., the mask is formed in an annular area outside the outer peripheral edge of the annular pattern 165 to be formed. The circuit board 39 is copper-plated until a height difference 165*c* reaches a required value. Then, the masks are removed to obtain the circuit board 39 on which the desired circular pattern 164, annular pattern 165, height difference 165*c*, and protruding surfaces 164*a* and 165*a* are formed.

In this example, the protruding surface 164*a* of the circular pattern 164 which constitutes an output terminal for external connection and protruding surface 165*a* of the annular pattern 165 which constitutes an earth terminal serve as reflow-soldering surfaces. Thus, there is the height difference 165*c* between the crimped surface 45*b* where the crimp edge 31*b* of the case is held in pressing contact with the annular pattern 165 and the reflow-soldering surface (the protruding surface 165*a*). The existence of the vertical height difference 165*c* and increase in creepage distance from the reflow-soldering surfaces to the crimp edge 31*b* due to the height difference 165*c* can prevent solder and flux which flow out of the reflow-soldering surface from flowing into the ECM 160. Furthermore, the thickness of the circular pattern 164 and annular pattern 165 reduces conduction of solder-melting heat to the ECM 160.

The existence of the height difference 165*c* prevents the crimp edge 31*b* from hitting a board surface of the mounting board 61 and thereby lifting the solder joint surface. Consequently, the ECM 160 can be reflow-soldered properly. That is, reflow soldering can be performed automatically, improving productivity in that respect.

Also, in this example, the slit 166 is provided in the protruding surface 165*a* of the annular pattern 165. The slit 166 serves as an air escape route, making it possible to prevent solder defects, deformation of the circuit board 39, etc. caused by thermal expansion of air.

Incidentally, although one slit 166 is provided in the protruding surface 165*a* in the above example, two or more slits 166 may be provided in the protruding surface 165*a*. Also, although three solder bump electrodes 47*b* are formed at 120-degree intervals on the protruding surface 165*a*, this is not restrictive and four or more solder bump electrodes 47*b* may be formed. However, the formation of three solder bump electrodes 47*b* as in this example makes it possible to place the ECM 160 horizontally on a wiring pattern on the mounting board in a stable manner.

Sixth Embodiment

Protruding surfaces of terminal electrode patterns can be formed by removing part of metal foil affixed to the outer surface of a circuit board, by etching. A sixth embodiment which involves this process will be described below.

FIGS. 14A to 14E are sectional views illustrating procedures for producing protruding surfaces of terminal electrode patterns according to this embodiment.

Figure 14A:
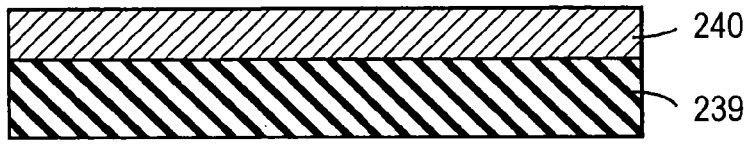
FIGS. 14A to 14E are sectional views illustrating procedures for producing protruding surfaces of terminal electrode patterns.

FIG. 14A shows a copper-foiled substrate. As this substrate is machined into a disk shape, a circuit board 239 to which copper foil 240 is affixed is obtained as a raw part. The circuit board 239 is made of synthetic resin approximately 200 μm in thickness, and copper foil approximately 175 μm in thickness is affixed to one surface of the circuit board 239.

Figure 14B:
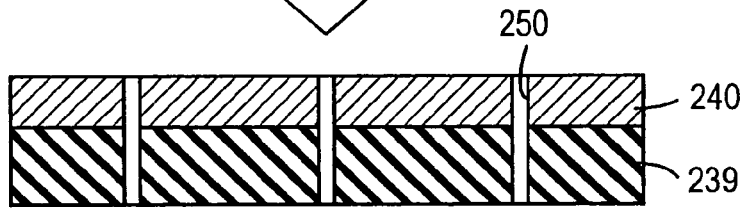

Next, as shown in FIG. 14B, thru-holes 250 are drilled at required locations, penetrating the circuit board 239 vertically.

Figure 14C:
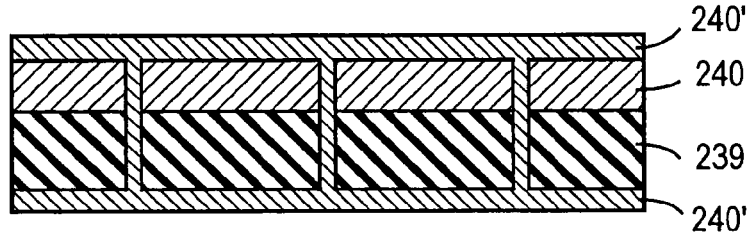

After the thru-holes 250 are drilled in the circuit board 239, both surfaces of the circuit board 239 are copper-plated until a copper-plated coating 240' approximately 18 μm in thickness is obtained as shown in FIG. 14C. The total thickness of the copper foil is 193 μm.

Figure 14D:
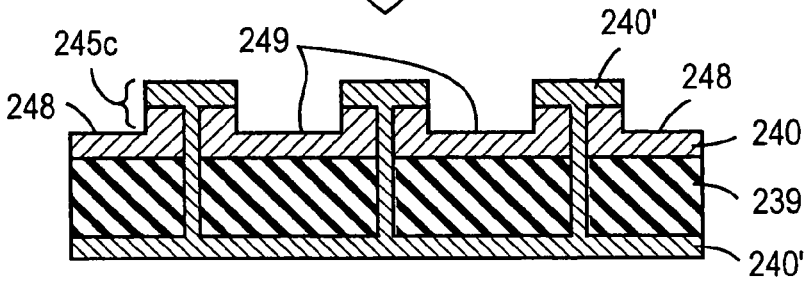

Next, as shown in FIG. 14D, masks are formed in those areas of the copper-plated coating 240' in which a protruding surface 244*a* of a circular pattern 244 and protruding surface 245*a* of an annular pattern 245 will be formed. That is, the copper-plated coating 240' is masked except for an annular area 249 between the outer peripheral edge of the protruding surface 244*a* of the circular pattern 244 to be formed and inner peripheral edge of the protruding surface 245*a* of the annular pattern 245 to be formed as well as an annular area 248 outside the outer peripheral edge of the protruding surface 245*a* of the annular pattern 245 to be formed. Then, the entire circuit board 239 is etched until a height difference 245*c* (or height) in the thickness direction of the copper foil 240 remaining on the surface of the circuit board 239 reaches a required height difference 245*c* (or height). FIG. 14D shows how etching is done until the height difference 245*c* (or height), i.e., the sum of the thickness of the copper foil 240 remaining on the surface of the circuit board 239 and the thickness of the copper-plated coating 240', reaches the height difference (or height) needed for the protruding surface 244*a* of the circular pattern 244.

Next, the mask is removed from the annular area 249 between the outer peripheral edge of the protruding surface 244*a* of the circular pattern 244 to be formed and inner peripheral edge of the protruding surface 245*a* of the annular pattern 245 to be formed. Then leaving the annular area 248 outside the outer peripheral edge of the protruding surface 245*a* of the annular pattern 245 to be formed, the entire circuit board 239 is etched. The etching is finished when both the copper foil 240 existing on the annular area 249 and the copper-plated coating 240' remaining on the circuit board 239 are etched out. Here, the copper foil 240 has been removed from the annular area 249. Then, the mask is removed from the annular area 248

Figure 14E:
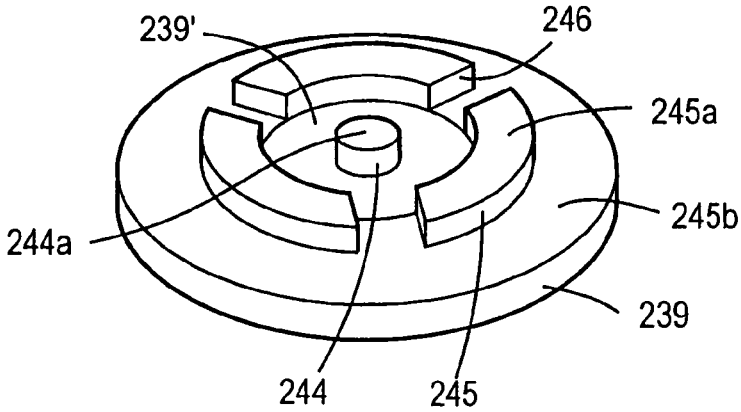

As shown in FIG. 14E, both the copper foil 240 existing on the annular area 249 and the copper-plated coating 240' remaining on the circuit board 239 are etched out. Consequently, the circuit board 239 is obtained with the desired circular pattern 244, annular pattern 245, height difference 245*c*, and protruding surfaces 244*a* and 245*a* formed on it. Incidentally, a surface 239' of the circuit board 239 is exposed.

The present invention is not limited to the above embodiments. For example, although the above embodiments have been described citing back electret type ECMs, the present invention may be applied to front electret type ECMs.

In the first to fourth embodiments, the thickness of the substrate affixed to the circuit board may be smaller than the height of the crimp edge from crimped surface on the outer surface of the circuit board. Also, the shape of the substrate and the like is not limited to those of the above embodiments. Also, although in the first to fourth embodiments, a through-hole serving as an air escape route is formed in the substrate, it is not strictly necessary to form the through-hole. It is alternatively possible to form solder bump electrodes between the circuit board and substrate and use a gap between the solder bump electrodes as an air escape route.

What is claimed is:

1. An electret-condenser microphone comprising:

a vibrating diaphragm and a back electrode which compose a condenser;

a cylindrical case which houses the vibrating diaphragm and the back electrode;

a circuit board which is housed in an opening of the cylindrical case and covers the opening, and which is fixed to the opening by a crimp edge at an opening end of the cylindrical case that bends inwardly; and a substrate fastened to an outer surface of the circuit board, wherein terminal electrode patterns are formed on the outer surface of the circuit board, first substrate electrode patterns are formed on a surface of the substrate which is opposite the circuit board and serves as a reflow-soldering surface, the terminal electrode patterns and the first substrate electrode patterns are connected with each other via first thru-holes in the substrate, and second thru-holes are formed in an area of the surface of the substrate where the first substrate electrode patterns are not formed and which connect a space enclosed by the circuit board, substrate and electrode patterns formed between the circuit board and the substrate with space that is external to the electret-condenser microphone.

* * * * *

UNITED STATES PATENT AND TRADEMARK OFFICE

CERTIFICATE OF CORRECTION

PATENT NO. : 7,352,873 B2
APPLICATION NO. : 10/554611
DATED : April 1, 2008
INVENTOR(S) : Yasuhiro Shigeno et al.

It is certified that error appears in the above-identified patent and that said Letters Patent is hereby corrected as shown below:

On the cover page under item (30) "Foreign Application Priority Data," the filing date of Japanese application no. 2004-131206 is:

-- Apr. 27, 2004 --

Signed and Sealed this

Second Day of February, 2010

David J. Kappos

David J. Kappos
*Director of the United States Patent and Trademark Office*